United States Patent [19]

Treffner et al.

[11] 4,018,116

[45] Apr. 19, 1977

[54] METHOD AND APPARATUS FOR CUTTING PLASTICS MATERIALS

[76] Inventors: Peter Treffner; Charles Treffner, both of 43 Yangoora Road, Belmore, Sydney, New South Wales, Australia

[22] Filed: Feb. 21, 1975

[21] Appl. No.: 551,631

[30] Foreign Application Priority Data

Feb. 27, 1974 Australia ..... 6747/74

[52] U.S. Cl. ..... 83/4; 83/16; 83/171; 83/651.1

[51] Int. Cl.[2] ..... B26D 4/00; B26D 7/10

[58] Field of Search ..... 83/16, 651.1, 171, 170, 83/4, 1

[56] References Cited

UNITED STATES PATENTS

| | | | |
|---|---|---|---|
| 3,212,376 | 10/1965 | Berenbak et al. | 83/4 |
| 3,757,617 | 9/1973 | Fabbri | 83/651.1 X |
| 3,786,701 | 1/1974 | Ludwig | 83/651.1 X |

FOREIGN PATENTS OR APPLICATIONS

| | | | |
|---|---|---|---|
| 511,319 | 3/1955 | Canada | 83/651.1 |

*Primary Examiner*—Othell M. Simpson
*Assistant Examiner*—W. D. Bray
*Attorney, Agent, or Firm*—Haven E. Simmons; James C. Nemmers

[57] ABSTRACT

Apparatus for cutting a body of rigid plastics foam material, such as polyurethane or poly-isocyanurate, comprises a bed for supporting the body and two sets of parallel cutting elements adapted to oscillate longitudinally out of phase with each other. The cutting elements may consist of helically twisted ribbons of electrical resistance alloy, twisted in such a way that the handedness of the twist varies at regular intervals along each element. The elements are heated to a temperature below the fusion temperature of the plastics material, and are passed through the body to sever it into a number of slabs.

7 Claims, 8 Drawing Figures

METHOD AND APPARATUS FOR CUTTING PLASTICS MATERIALS

BACKGROUND OF THE INVENTION

The present invention relates generally to cutting devices, and more particularly to devices useful for cutting rigid plastics foams.

It is well known that certain rigid plastics foams, such as polystyrene may readily be cut with heated wires. These wires are heated to a temperature above the fusion temperature of the plastics material, and are passed through a body of the material in a direction which may be perpendicular to their longitudinal axes.

Conventional hot wire techniques as described in the previous paragraph make little impression upon certain foam plastics materials such as polyurethane foam (especially "self-extinguishing" polyurethane foam) and poly-isocyanurate.

In U.S. Pat. No. 3,786,701, issued to Eugene A. Ludwig, a modified hot wire cutting device has been described which is claimed to be useful for cutting polyurethane foam and like. According to the Ludwig patent, a conventional hot wire cutting device is modified by oscillating the entire cutting assembly, upon which the heated wires are mounted, transversely of the direction of the cut.

As in the conventional hot wire cutting technique, the wires are heated above the fusion temperature of the foam, and the oscillatory action serves to impede the build up of fused resin on the wires.

By this method, the build up of fused plastics material cannot be entirely eliminated. With self-extinguishing polyurethane foam (which incorporates a filler substance which is substantially non-fusable at the temperature of the cutting wire) the problem is increased by the build up on the wire of an insulated layer of filler and insufficiently fused polyurethane which slows up and eventually prevents the thermal cutting action. Another foam plastics material which presents particular problems is poly-isocyanurate. This appears to pyrolize at the wire temperature, leaving a residue of carbonaceous material on the wires.

A further problem inherent in the Ludwig cutter is that the oscillating wires exert lateral forces on the body of material being cut, and tend to shift it sideways. These forces increase as fused or charred material builds up on the wires. To avoid the body shifting sideways, it is necessary to anchor it firmly, or to place weights on the top of it.

Plastics foam materials which cannot be cut by a hot wire have hitherto been cut by conventional sawing methods. For example, polyurethane slabs for insulation purposes are usually cut from a block of rigid foam with a band saw. The cutting operation is time consuming because only one cut may be made at a time. Because the blocks of polyurethane foam which are cut are usually several feet wide, it is impractical to use a saw which cuts with an oscillating movement. Any such oscillating saw would need to have an amplitude of oscillation which exceeded the width of the block, to ensure sufficient clearing of swarf from the cutting region.

Another problem associated with the use of band saws arises from the band like nature of the blade. Any slight deflection of the band (for example through inhomogeneity of the block of material being cut) tends to twist the blade, causing a wavy or rippled cut surface.

It is an object of the present invention to provide an improved method and apparatus for cutting foamed plastics materials, including those which cannot be cut by conventional hot wire techniques.

It is another object of the invention to provide a method and apparatus for making multiple cuts in a block of foamed plastics material, including those materials which cannot be cut by conventional hot wire techniques.

It is a further object of the invention to provide apparatus for cutting polyurethane foams and the like, which apparatus employs a substantially filamentary cutting element, as hereinafter defined.

SUMMARY OF THE INVENTION

The present invention overcomes problems inherent in the prior art and achieves one or more of the foregoing objects by employing substantially filamentary oscillating cutting elements (as hereinafter defined), which operate at temperatures which are below the fusion temperature of the plastics foam material, but are sufficiently high that the material is softened. It is highly desirable that the substantially filamentary cutting element be shaped in such a way that swarf from the cut block is able to pass behind the advancing cutting elements.

According to one aspect of the invention there is provided apparatus for cutting a body of rigid plastics foam material comprising in combination:

a. means for supporting said body of plastics material;

b. at least one substantially filamentary cutting element;

c. means for oscillating said cutting element along its longitudinal axis;

d. means for heating said cutting element to a temperature not exceeding the fusion temperature of the plastics material to be cut; and e. means for causing relative movement between said body and said cutting element in a direction having a component perpendicular to the longitudinal axis of said cutting element.

The movement of the cutting element through the body of plastics foam material may be effected either by movement of said body or by movement of said cutting element.

The term "substantially filamentary cutting element" as used in the present specification and claims refers to a cutting element having a length greatly in excess of its maximum cross-sectional dimension, whereof the cross-section varies in shape or disposition along the length of the element, and whereof those parts protruding furthest from the longitudinal axis of the element lie in a smooth notional envelope of constant cross section; the ratio of the maximum to minimum cross-sectional dimension of that envelope being less than 2:1.

By way of example, a preferred embodiment of the invention is described with reference to the accompanying drawings in which:

DESCRIPTION OF THE PREFERRED EMBODIMENT

Figure 1:
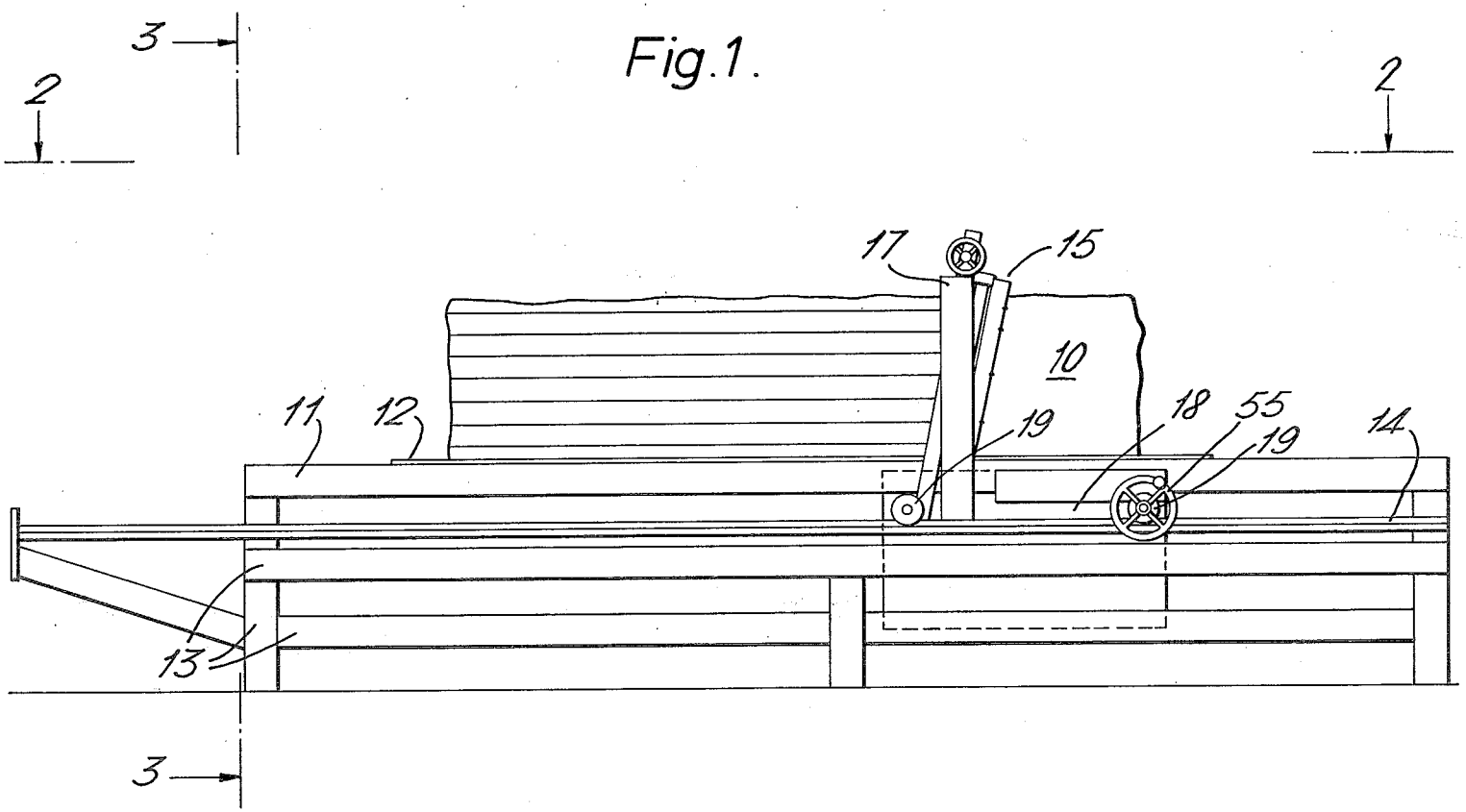
FIG. 1 is a side elevation of cutting apparatus according to the invention.
Figure 2:
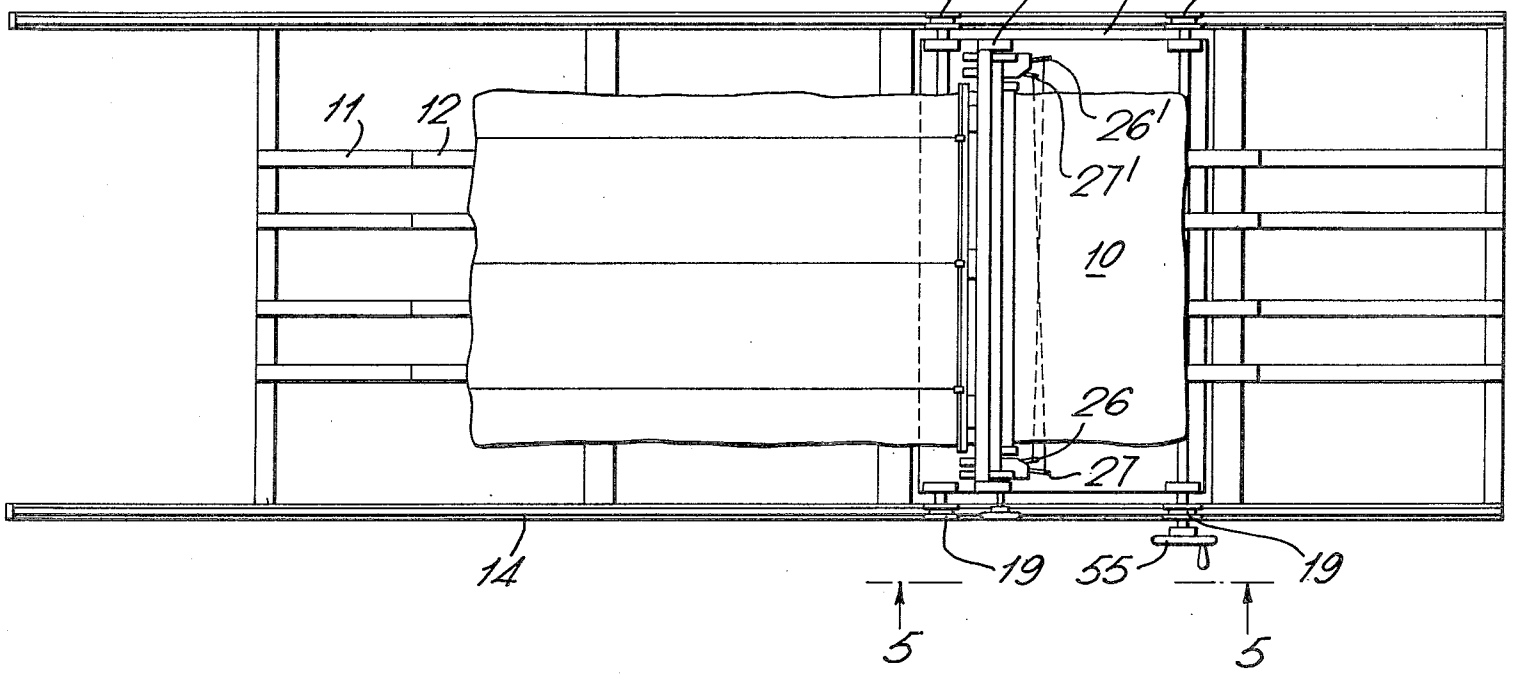
FIG. 2 is a plan view of the apparatus according to FIG. 1.
Figure 3:
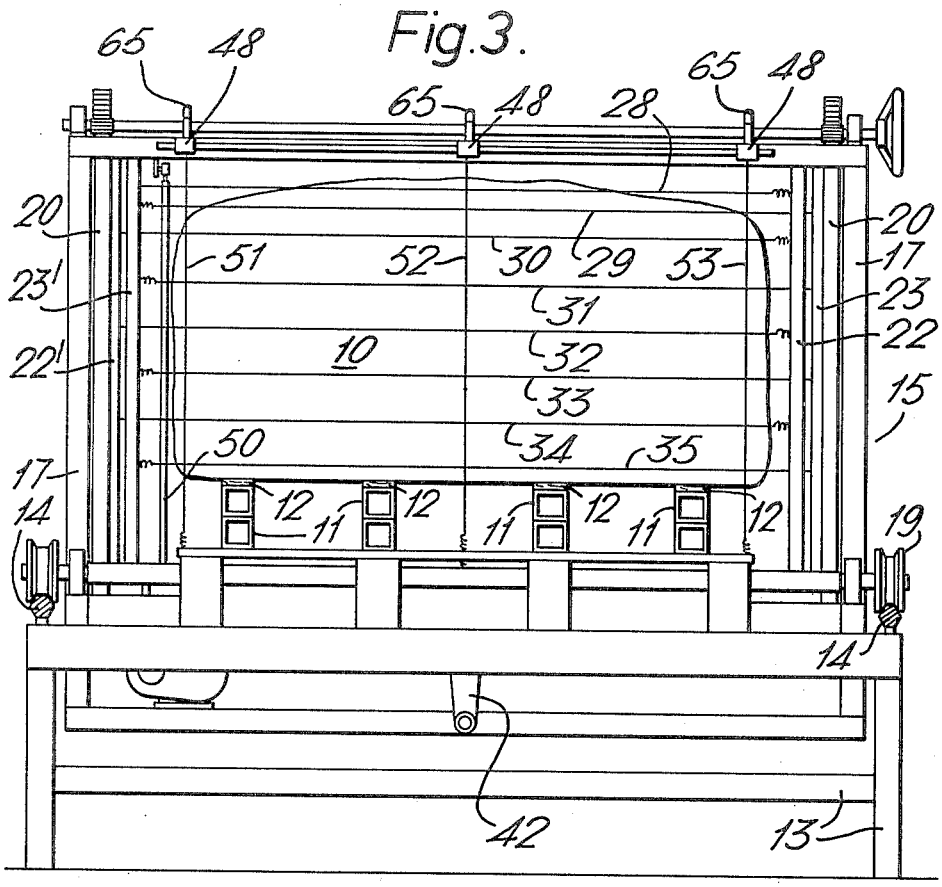
FIG. 3 is an end elevation of the apparatus according to FIG. 1.
Figure 4:
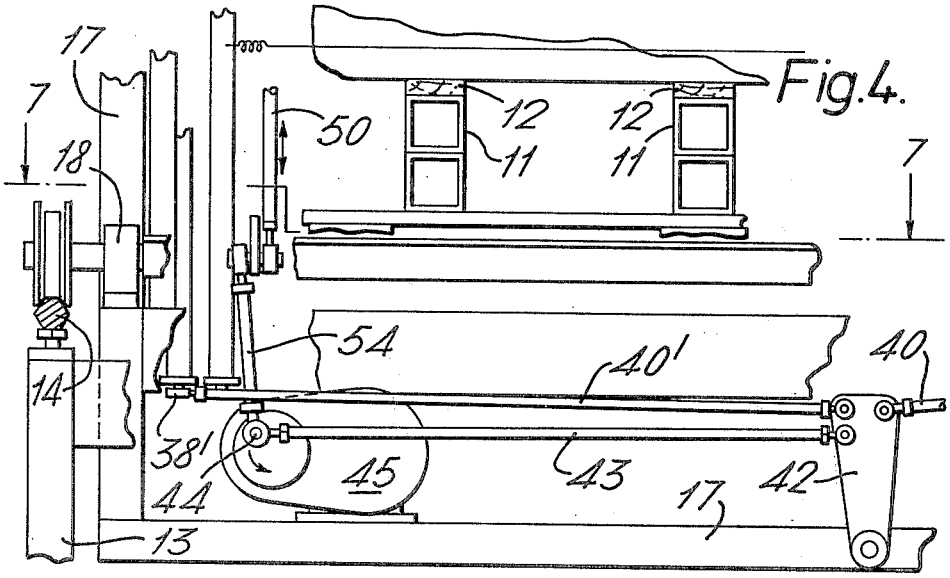
FIG. 4 is a detailed sectional end elevation of the apparatus according to FIG. 1.

Referring now to FIGS. 1, 2 and 3 a block 10 of foamed plastics material rests on a flat horizontal bed defined by longitudinal rails 11. Rails 11 and their supporting framework are constructed from steel sections. Flatness of the bed is ensured by the provision of timber slats 12 which are screwed to the upper surfaces of rails 11 and planned to be horizontally flat when the bed is placed in its position on the factory floor.

The supporting framework for rails 11, denoted generally as 13, also carried a pair of horizontal, longitudinal guide rails 14.

Guide rails 14 support a horizontal cutting assembly, denoted generally as 15, and comprising a substantially vertical rectangular frame 17 which is preferably of rectangular steel section, and which is rigidly attached to a supporting carriage 18. Carriage 18 is fitted with wheels 19 which enable it to be moved along guide rails 14.

Figures 5, 6:
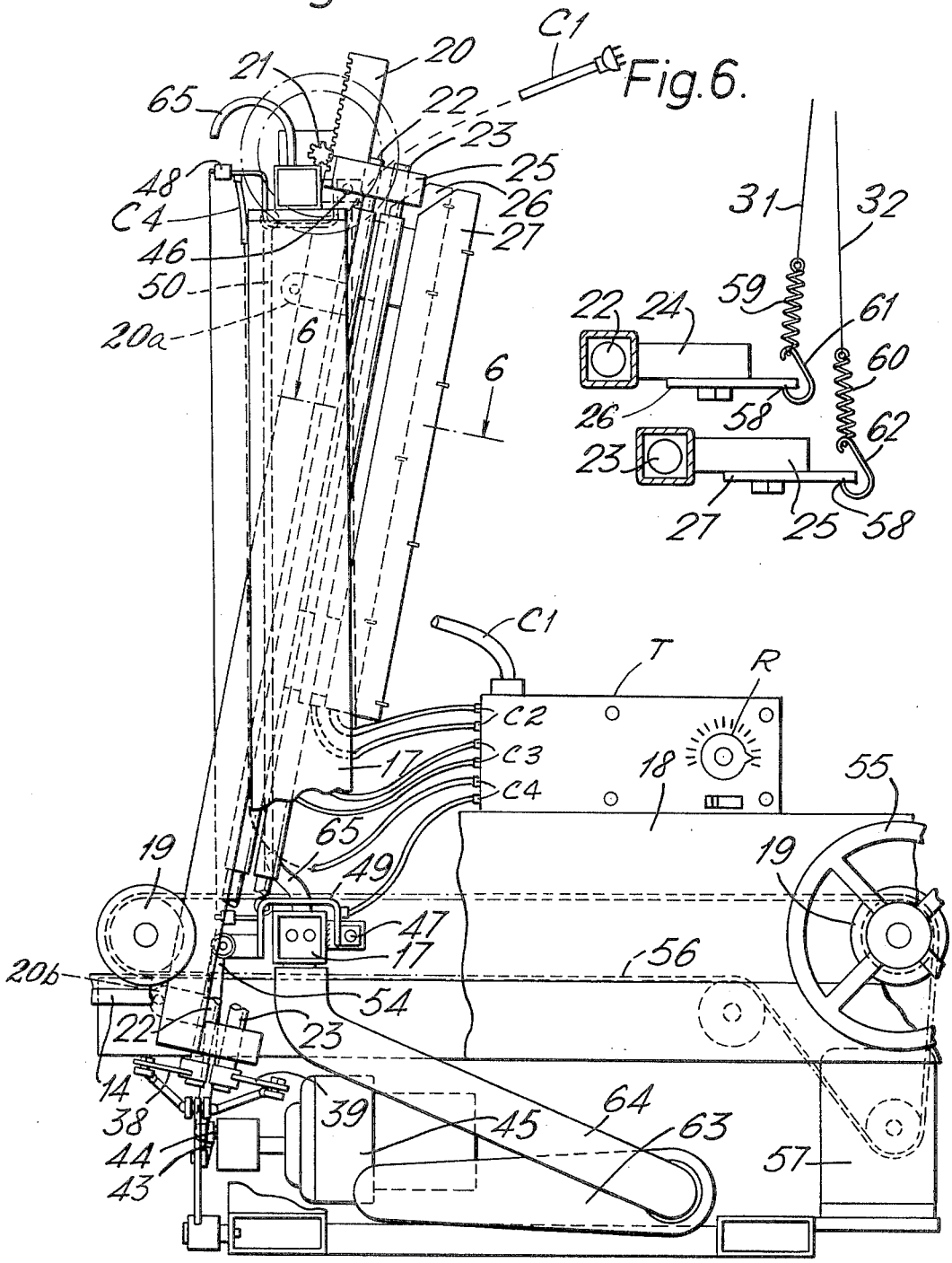
FIG. 5 is a sectional side elevation of part of the apparatus according to FIG. 1.
FIG. 6 is a sectional view along the line 6—6 in FIG. 5.

As shown most clearly in FIGS. 3 and 5, frame 17 carries a pair of bars 20 which appear vertical in end elevation but are inclined slightly away from the vertical when seen in side elevation. Bars 20 are mounted in upper and lower guides 20*a* and 20*b* fixed to the frame 17 and the carriage 18, respectively, so that the bars 20 are movable within limits in their longitudinal direction. Such movement, controlled by a rack and pinion arrangement 21, facilitates adjustment of the cutting element height, as will be seen below.

Each of said bars 20 carries insulatory brackets 24 and 25 pierced by stub axles 22, 23 or 22′, 23′ respectively. These axles extend parallel to the bars 20 and are each rotatable about their longitudinal axis. The axles are fixed to upright flaps 26, 27, 26′ or 27′.

Horizontal cutting elements 28, 29, 30, 31, 32, 33, 34 and 35 are carried by pairs of flaps 26 and 26′ or 27 and 27′. As illustrated in FIG. 3, the even numbered cutting elements are carried by flaps 26 and 26′, and odd numbered cutting elements are carried by flaps 27 and 27′. In this way, adjacent cutting elements are supported by different pairs of flaps.

Figure 7:
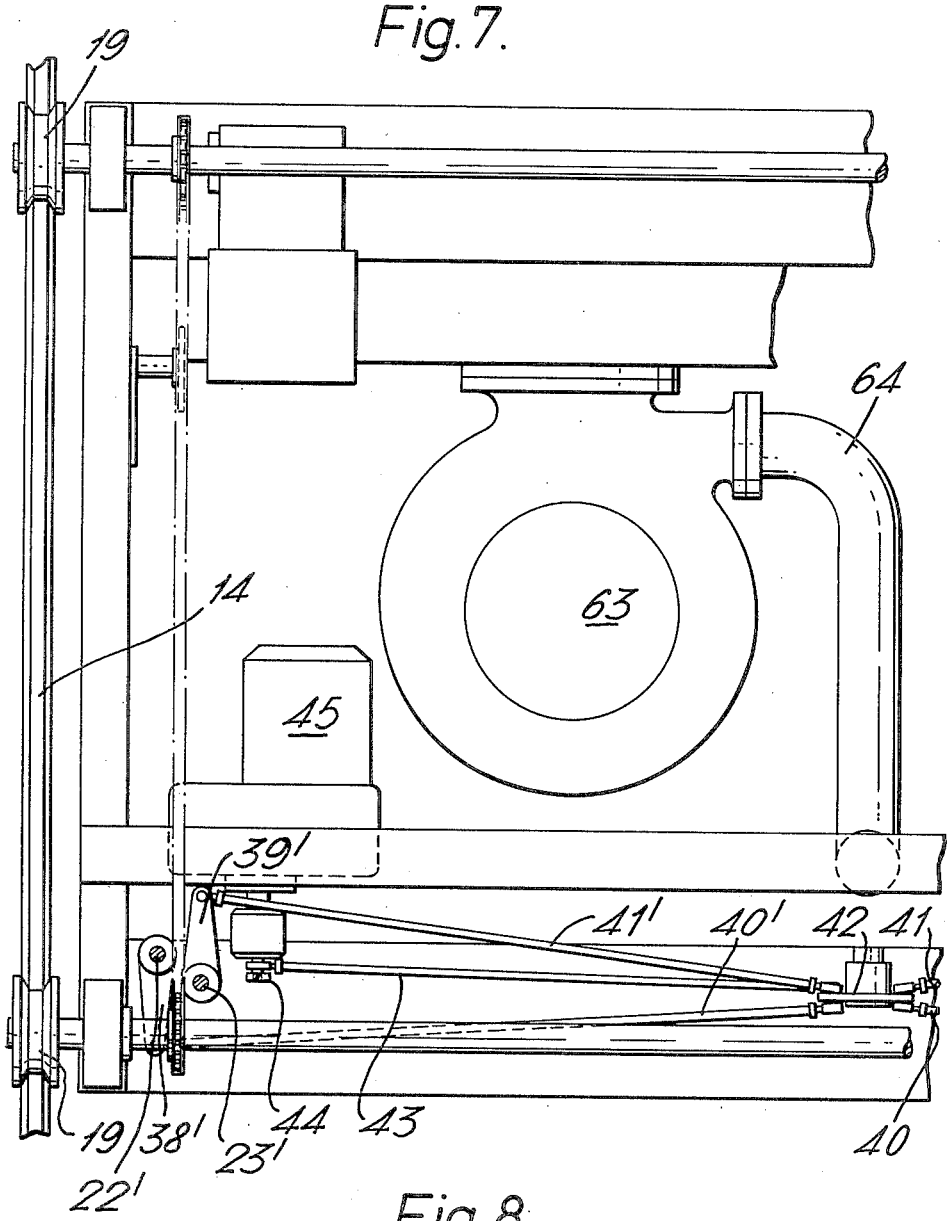
FIG. 7 is a sectional view along the line 7—7 of FIG. 4.

Flaps 26, 26′, 27 and 27′ are adapted to oscillate about the respective axes of axles 22, 22′, 23, and 23′ in such a way that flaps 26 and 26′ oscillate in phase with each other, and flaps 27 and 27′ oscillate in phase with each other, but the pairs of flaps 26, 26′ and 27, 27′ oscillate directly out of phase. The required movement of axles 22, 22′, 23 and 23′ is effected by cantilevers 38, 38′, 39 and 39′, as seen best in FIG. 5 and FIG. 7. The cantilevers are driven by connecting links 40, 40′, 41 and 41′, which in turn are driven by lever 42. Lever 42 is caused to oscillate by connecting rod 43 which is driven by crank 44 on motor 45.

Frame 17 also carries top and bottom horizontal axles 46 and 47, which may be seen from FIG. 5. Top and bottom levers 48, 49 are pivotted about axles 46 and 47 respectively, and are irregularly shaped to clear the top and bottom horizontal members of frame 17. Levers 48 and 49 are connected by a tie rod 50 which ensures that they move in phase. Respective pairs of levers 48 and 49 carry three vertical cutting elements 51, 52 and 53 which are caused to oscillate vertically by synchronized movement of levers 48 and 49 about axles 46 and 47. Such movement is imparted to lever 49 by connecting rod 54 which is driven by crank 44, and is transmitted to levers 48 by the tie rod 50. It will be noted that in the illustrated embodiment the three vertical cutting elements 51, 52 and 53 all oscillate in phase with each other. In other embodiments, the vertical elements could be caused to oscillate in two out of phase sets as the horizontal elements do.

In the illustrated embodiment, the block of plastics foam to be cut remains stationary relative to the factory floor while the cutting assembly 15 moves. In other embodiments equally within the scope of the invention, the block could be moved relative to a stationary cutting assembly. However, the illustrated embodiment is to be preferred because it allows longer cuts to be made by a machine occupying any given floor area.

Cutting assembly 15 is carried along guide rails 14 on carriage 18. Carriage 18 may be driven by hand using hand wheel 55, or may be driven via a drive chain 56 by motor 57.

Cutting elements 28 to 35 and 51 to 53 are heated to and maintained at their operating temperature by passing an electric current through them. The electric current may be supplied by a transformer T and variable resistor R which together with other appropriate switches and controls may be mounted in a housing atop one side of the carriage 18 and are connectible to a suitable source of power through an overhead traveling cable C1 which runs down one leg of the frame 17, as shown in FIG. 5. The output of the transformer T applies a potential difference between flaps 26 and 27, 26′ and 27′, through cables C2 and C3, respectively, and between levers 48 and 49 through cables C4. To avoid fatigue in the cutting elements through flexing, while providing electrical contact between the cutting elements and their supporting flaps or levers, a preferred method of attachment is used as shown in FIG. 6. Flaps 26 and 27 are provided with indentations 58 close to their outer distal edges. The cutting elements 31, 32 terminate in coil springs 59 and 60 and hooks 61 and 62. These are shaped and proportioned so that the points of hooks 61, 62 fit into the indentations 58 on respective flaps 26, 27 and hooks 61, 62 pass around and clear the outer edges of 26, 27. Tension in cutting elements 31, 32 is maintained by springs 59, 60. Because of the point contact between hooks 61, 62 and flaps 26, 27, substantially no flexure of cutting elements 31, 32 takes place. Spring and hook arrangements may be provided at either or both ends of each of the cutting elements.

As stated above, in preferred embodiments of the invention, and particularly when it is desired to cut materials such as polyurethane foam and polyisocyanurate foam, the temperature of the cutting element is kept below the fusion temperature of the material being cut. Because heat is more rapidly dissipated within the body of the foam, there is a tendency for those parts of the cutting element which emerge from the body due to their oscillation to become overheated, and to fuse or char the body being cut close to its edges. To overcome this problem, it is preferred to cool the emergent ends of the cutting elements by blowing air onto them. For this purpose, a blower 63 is provided to direct a stream of cool air via ducts and nozzles on to the ends of the cutting elements. In the illustrated embodiment, air is fed from blower 63 through the main duct 64 into the hollow members of frame 17. Frame 17 therefore performs a secondary function as an air duct. Nozzles 65 are provided at intervals around frame 17 to direct cooling air into the ends of the cutting elements.

As previously stated, preferred embodiments of the invention employ a cutting element which is shaped in such a way that swarf from a block of material being cut is able to pass behind the advancing cutting element. In other words, when viewed from the direction of advancement of the cutting element through the block of material being cut, the cutting element presents at least one profile which is not a straight line.

The cutting element may be a single wire whose surface has been roughened, for example by a rolling or cutting action, or by the acretion of grit or other particles along its length. Alternatively, the cutting element may comprise two or more strands of smooth wire twisted together to provide a composite wire having a non-cylindrical surface. In one preferred form of the invention, the cutting element consists of a helically twisted ribbon of narrow strip material.

It has been found that uniformly twisted wires or ribbons tend to shift transversely of the cutting direction, causing a non-planar cut. If a planar surface is desired, it is therefore highly preferable to provide a cutting element whose twist is non-uniform. For example, a ribbon may be twisted alternately clockwise and anti-clockwise over relatively short equal sections of its length.

Figure 8:
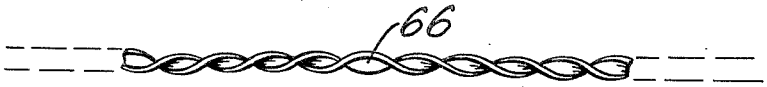
FIG. 8 is a detailed view of a short length of a preferred cutting element according to the invention.

The cutting element of FIG. 8 may be made by twisting a strip of resistance alloy. It will be noted that the handedness of the twist changes at the point denoted 66. A cutting element of the type illustrated in FIG. 8 which has been found particularly suitable for cutting rigid polyurethane foam blocks of approximately 6 feet width is made from nickel/chrome resistance alloy strip, 0.008 inch thick and 1/32nd inch wide. The strip is twisted through approximately four and a half complete turns per inch and the handedness of the twist changes about every nine complete turns.

While the manner of use of the apparatus will be readily apparent to those skilled in the art from the foregoing description, it may be briefly summarized as follows: A block of foam material is placed on the slats 12 and if necessary secured in position with the cutting assembly at one end of the guide rails 14. When the block is in position, the cutting assembly is moved towards the block, and the motor 45 and blower 63 are switched on. Just before the cutting elements come into contact with the block, the heating current is also switched on so that the cutting elements reach the block at an elevated temperature but not exceeding that of fusion of the material. The cutting assembly continues to move so that the cutting elements cut through the block until its length has been traversed. As soon as the cutting elements emerge from the block, first the heating current and then the blower 63 and motor 45 are switched off. The trimmed slabs of cut polyurethane may then be lifted off the slats 12.

We claim:

1. Apparatus for cutting a body of rigid plastics foam material comprising in combination;

a. means for supporting said body of plastics material;

b. a plurality of cutting elements including at least one set of substantially co-planar mutually parallel cutting elements;

c. means for oscillating the cutting elements of said set so that any pair of mutually adjacent cutting elements of said set oscillate directly out of phase with each other;

d. means for heating said cutting elements to a temperature not exceeding the fusion temperature of the plastics material to be cut; and e. means for causing relative movement between said body and said cutting elements in a direction having a component perpendicular to the plane defined by said set of cutting elements;

f. said cutting elements having a length greatly in excess of their maximum cross sectional dimension, and a cross section which varies along the length of each element, whereof those parts protruding furthest from the longitudinal axis of each element lie in a smooth notional envelope of constant cross section; the ratio of the maximum to minimum cross sectional dimension of that envelope being less than 2 to 1.

2. Apparatus according to claim 1 wherein each of said cutting elements comprises a helically twisted ribbon of narrow strip material, the handedness of which varies regularly along the length of said ribbon.

3. Apparatus according to claim 1, wherein said means for heating said cutting elements comprises means for causing an electric current to flow through said elements.

4. A substantially filamentary cutting element for cutting a body of rigid plastics foam material by oscillating movement of the cutting element along its longitudinal axis, the cutting element consisting of a single helically twisted ribbon of strip material composed of electrical resistance alloy having a length greatly in excess of its maximum cross-sectional dimension, the handedness of said twist changing at relatively short intervals along the length of the ribbon.

5. A cutting element according to claim 4 wherein the handedness of said twist changes at regular intervals of about 2 inches along the length of the ribbon.

6. A cutting element according to claim 4 wherein those parts of the ribbon protruding farthest from said longitudinal axis lie in a smooth notional envelope of constant cross section, the ratio of the maximum to the minimum cross-sectional dimension of that envelope being less than 2 to 1.

7. A cutting element according to claim 6 wherein the width of the ribbon is from about two times to about eight times its thickness.

* * * * *